United States Patent [19]

Rogowski et al.

[11] Patent Number: 4,660,475

[45] Date of Patent: Apr. 28, 1987

[54] SPOOLED PROPELLANT CHARGE AND METHOD OF MANUFACTURE THEREOF

[75] Inventors: Gerald W. Rogowski, Hyrum; Frank H. Bell, Logan, both of Utah

[73] Assignee: Morton Thiokol, Inc., Chicago, Ill.

[21] Appl. No.: 761,130

[22] Filed: Jul. 31, 1985

[51] Int. Cl.[4] ..... C06D 5/06

[52] U.S. Cl. ..... 102/284; 264/3.2; 264/3.3

[58] Field of Search ..... 264/3 R, 3 A, 3 B, 3.1, 264/3.2, 3.3; 102/284

[56] References Cited

U.S. PATENT DOCUMENTS

| | | | |
|---|---|---|---|
| 3,216,307 | 11/1965 | Griffith | 264/3 B |
| 3,348,445 | 10/1967 | Nadel | 102/289 X |
| 3,574,800 | 4/1971 | Pierce | 264/3 B |
| 3,608,421 | 9/1971 | Gibbon et al. | 264/3 B X |
| 3,811,358 | 5/1974 | Morse | 102/287 X |
| 4,068,589 | 1/1978 | Oversohl | 264/3 R X |

*Primary Examiner*—Peter A. Nelson

*Attorney, Agent, or Firm*—James C. Simmons; Gerald K. White

[57] ABSTRACT

A propellant charge is manufactured by spooling a strand of propellant onto a form member. In accordance with one embodiment of the invention, the form member is a spool composed of propellant, and the spooled propellant, including the spool, is loaded into a charge housing.

18 Claims, 3 Drawing Figures

SPOOLED PROPELLANT CHARGE AND METHOD OF MANUFACTURE THEREOF

The present invention relates to propellant charges.

Propellant charges are manufactured by insertion of a propellant material into a housing such as a cartridge case or charge bag. Methods are continually being sought to pack an increasingly greater number of net pounds of propellant into a fixed volume for preparation of propellant charges. One such method involves the manual binding together of cut sticks of propellant known as "cordite" type propellant and inserting the cut sticks of propellant into the cartridge case or charge bag parallel to the axis of the gun bore and the central igniter flash tube. However, such a method requires more cutting and more handling of the propellant than is desirable.

It is therefore an object of the present invention to provide a propellant charge which contains a maximum number of net pounds of propellant for the fixed volume thereof.

It is another object of the present invention to provide such a propellant charge wherein the amount of handling of the propellant is minimized.

It is still another object of the present invention to provide such a propellant charge which is inexpensive, not labor intensive, and yet provides ease of manufacture so as to more consistently provide high quality.

These and other objects of the invention will become apparent in the following detailed description of the preferred embodiments of the invention taken in connection with the accompanying drawings.

DETAILED DESCRIPTION OF THE PREFERRED EMBODIMENTS

Figure 1:
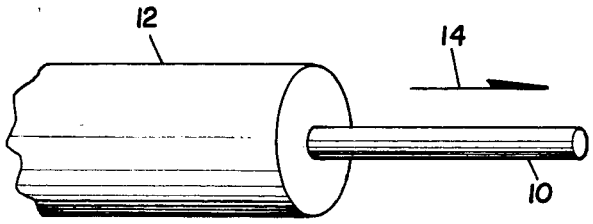
FIG. 1 is a schematic illustrating the extruding of a propellant strand in accordance with the present invention.

Referring to FIG. 1, there is shown schematically a method of extruding a continuous propellant strand 10 wherein propellant material is fed through a die 12 in direction 14 and the strand 10 of propellant material is extruded therefrom. However, it should be understood that any other suitable method of preparing a strand of propellant may be used and is meant to come within the scope of the present invention.

Figure 2:
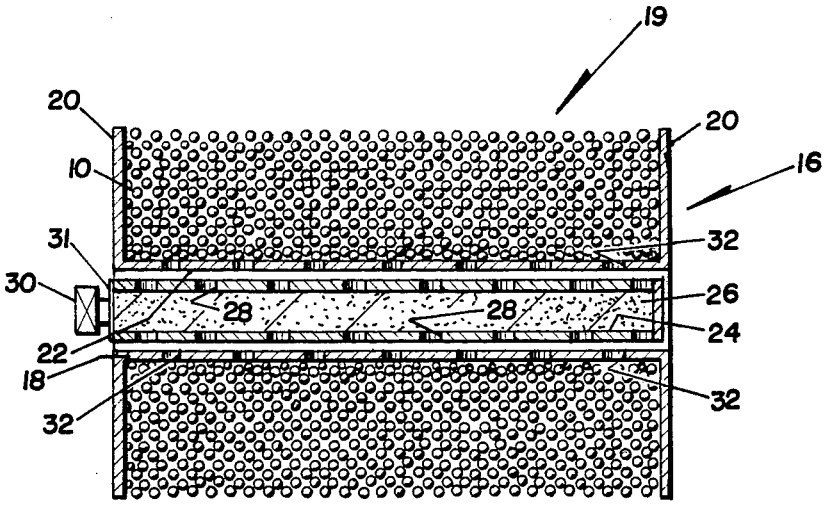
FIG. 2 is a cross sectional view of a propellant coil embodying the present invention.

Referring to FIG. 2, there is shown at 16 a form member which includes an elongated member 18 upon which the extruded continuous strand of propellant 10 is spooled, that is, wound upon the elongated member 18 to thus form a propellant coil 19 in accordance with the present invention in order to thereby reduce handling of the propellant during preparation of a propellant charge and provide an increased weight of propellant per a fixed volume. For the purposes of this specification and the claims, the term "spooled propellant" refers to a propellant strand which has been spooled onto an elongated member whether or not the elongated member is subsequently removed therefrom. The propellant strand 10, which is shown in FIGS. 1 and 2 as having a circular cross section, may have any other suitable cross section such as, for example, square, ribbon-shaped, horseshoe shaped, or slotted circular shaped and may typically range in diameter between about 0.02 inch and about 0.31 inch. Member 18, which is shown in FIGS. 2 and 3 as having a cylindrical shape, may have any other shape suitable for spooling propellant thereon.

In order to maintain the integrity of the propellant coil 19 on the cylindrical member 18, the form member 16 is also preferably provided with a rim or ridge member 20 at each end of the cylindrical member 18 and extending radially outwardly therefrom a distance equal substantially to the depth of winding of the strand 10 on the member 18 such that the form member 16 has the shape of a spool.

The cylindrical member 18 is preferably provided with a hollow core or bore 22 for insertion of a suitable igniter 24 which includes a suitable propellant 26 and which is provided with apertures 28. A primer for the igniter 16 is shown schematically at 30 and a conventional burst disk having a thickness of typically 0.0010 to 0.0015 in. is shown at 31. The spool 16 is preferably composed of a suitable single, double, or multi-based propellant in order to effectively maximize the amount of propellant charge within the available space, or it may be composed of any other suitable combustible material. The cylindrical member 18 is preferably composed of a high burning rate sheet propellant such as, for example, a modified nitrocellulose known as "mortar flake" whereby it may act as a combustible and energetic flash tube for the propellant charge. Apertures or slots illustrated at 32 are preferably provided in the wall of the flash tube 18 to provide communication between the hollow core 22 and igniter 24 contained therein and the wound propellant 10 for an increased burning rate.

Figure 3:
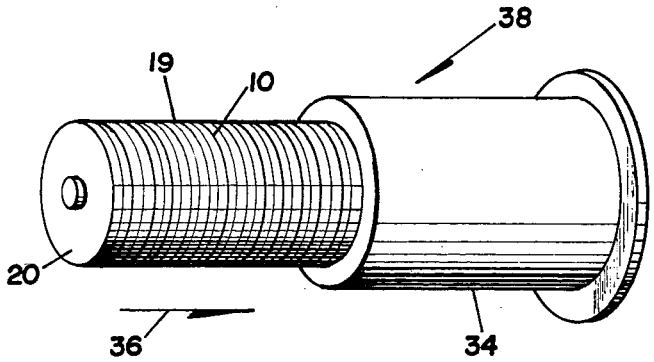
FIG. 3 is a perspective view showing the loading of a propellant coil into a charge housing in accordance with the present invention.

After the propellant strand, which may be composed of any suitable propellant such as, for example, a composition of nitrocellulose, nitroglycerine, and petroleum jelly known as "cordite" has been spooled onto the spool 18, it may be cured or dried as required, and then the spooled propellant may be inserted, as required, into a charge housing 34, as illustrated by arrow 36 in FIG. 3, to thereby provide a propellant charge 38.

The charge housing 34 may be of any suitable type commonly known to those of ordinary skill in the art to which the invention pertains. For example, the charge housing 34 may be a straight sided or nearly straight sided cartridge case used for fixed and semi-fixed cartridge munitions, for example, fixed type rounds used for the main gun of a tank or other large offensive vehicle including navel ships. For another example, the charge housing 34 may be a cylindrical powder bag for a bag charged gun.

In accordance with an alternative embodiment of the present invention, the propellant spool 16 may be eliminated from the propellant charge in which case the propellant coil 19 may be shaped from a propellant strand 10 by coiling the strand 10 upon an elongated member 18, then curing or drying it as required, then removing it from the member 18 as a nearly liquid, elongated, multi-row coil for loading into the charge housing 34. The hollow core resulting when the coil is removed from the elongated member 18 may then be loaded with propellant to effectively maximize the amount of propellant within the available space.

Thus, the present invention provides a method of manufacturing a propellant charge whereby a maximum number of pounds of propellant per unit volume may be loaded, but with a minimum amount of labor. Although the usefulness of the present invention is not limited to any particular size gun, the method and propellant charge of the present invention are more particularly useful for cannon, that is, guns having a bore diameter of at least about 20 mm. In accordance with an aspect of the invention, a combustible spool 16 is thus useful, not only as part of the propellant charge, but also as both a propellant winding jig and a propellant loading tool.

It is to be understood that the invention is by no means limited to the specific embodiments which have been illustrated and described herein, and that various modifications thereof may indeed be made which come within the scope of the present invention as defined by the appended claims.

We claim:

1. A method of manufacturing a propellant charge comprises the steps of:

a. preparing a strand of propellant;

b. preparing a form member to include an elongated member and a ridge member at each end of the elongated member which ridge member extends radially outwardly from the elongated member such that the form member has the shape of a spool upon which the propellant strand may be spooled; and c. spooling the propellant strand on the form member between the ridge members whereby the ridge members serve to maintain the integrity of the spooled propellant on the elongated member.

2. A method according to claim 1 further comprises forming the form member from propellant.

3. A method according to claim 2 further comprises forming a hollow core in the form member and inserting an igniter in the hollow core.

4. A method according to claim 3 further comprises forming apertures in the core to provide communication between the igniter and the spooled propellant.

5. A method according to claim 2 further comprises loading the spooled propellant into a charge housing.

6. A method according to claim 5 wherein the step of loading the spooled propellant includes loading the form member with the propellant spooled thereon into the charge housing.

7. A method according to claim 5 further comprises curing the spooled propellant before loading it into a charge housing.

8. A method according to claim 1 further comprises loading the spooled propellant into a charge housing.

9. A method according to claim 1 wherein the step of preparing the propellant strand comprises extruding the propellant strand.

10. A propellant charge comprises a form member including an elongate member and a ridge member disposed at each end of and extending radially outwardly from said elongate member such that the form member has the shape of a spool, and at least one strand of propellant material spooled on said form member between said ridge members whereby the ridge members serve to maintain the integrity of the spooled propellant on the elongate member.

11. A propellant charge according to claim 10 wherein said form member is composed of propellant material.

12. A propellant charge according to claim 10 further comprises a charge housing in which said form member with propellant material spooled thereon is inserted.

13. A propellant charge according to claim 10 further comprises means defining a hollow core in said form member for inserting an igniter, and an igniter inserted in said hollow core.

14. A propellant charge according to claim 13 further comprises means defining apertures in said form member for providing communication between said hollow core and said spooled strand of propellant material.

15. A propellant charge according to claim 10 wherein said strand of propellant material is extruded propellant material.

16. A propellant charge comprises a form member composed of propellant material and at least one strand of propellant material spooled onto said form member.

17. A propellant charge according to claim 16 further comprises means defining a hollow core in said form member for inserting an igniter, and an igniter inserted in said hollow core.

18. A propellant charge according to claim 17 further comprises means defining apertures in said form member for providing communication between said hollow core and said spooled strand of propellant material.

* * * * *